US008127684B2

(12) United States Patent
Taylor et al.

(10) Patent No.: US 8,127,684 B2
(45) Date of Patent: Mar. 6, 2012

(54) CHARGE MOUNT

(75) Inventors: John Taylor, Grange-Over-Sands (GB); Raphael Joseph Francis Chetcuti, Askam-in-Furness (GB); Charles Thomas Marshall, Erskine (GB); Colin Carson MacKenzie, Erskine (GB)

(73) Assignee: BAE Systems plc, London (GB)

( * ) Notice: Subject to any disclaimer, the term of this patent is extended or adjusted under 35 U.S.C. 154(b) by 230 days.

(21) Appl. No.: 12/278,113

(22) PCT Filed: Jul. 2, 2008

(86) PCT No.: PCT/GB2008/050532

§ 371 (c)(1),
(2), (4) Date: Aug. 1, 2008

(87) PCT Pub. No.: WO2009/004384

PCT Pub. Date: Jan. 8, 2009

(65) Prior Publication Data

US 2010/0154624 A1 Jun. 24, 2010

(30) Foreign Application Priority Data

Jul. 4, 2007 (GB) ..... 0713369.7

(51) Int. Cl.
*F42B 5/18* (2006.01)

(52) U.S. Cl. ..... 102/431; 102/526; 89/45

(58) Field of Classification Search ..... 102/439, 102/524, 525, 526, 527, 528, 431; 89/1.703, 89/1.806, 45, 14.05
See application file for complete search history.

(56) References Cited

U.S. PATENT DOCUMENTS

| | | | | |
|---|---|---|---|---|
| 29,272 | A * | 7/1860 | Hotchkiss | 102/525 |
| 1,861,522 | A * | 6/1932 | Brandt | 102/527 |
| 3,687,079 | A * | 8/1972 | Scollins | 102/526 |
| 3,754,726 | A * | 8/1973 | Rusbach | 102/348 |
| 4,047,466 | A * | 9/1977 | Berman | 102/526 |
| H198 | H * | 1/1987 | Stone | 102/524 |
| 5,492,064 | A * | 2/1996 | Boutet | 102/524 |
| 6,295,934 | B1 * | 10/2001 | Tepera et al. | 102/525 |
| 6,453,821 | B1 * | 9/2002 | Fowler et al. | 102/527 |
| 7,040,237 | B2 * | 5/2006 | Tilling et al. | 102/524 |

FOREIGN PATENT DOCUMENTS

| | | | |
|---|---|---|---|
| EP | 0 502 753 | A1 | 9/1992 |
| EP | 0 775 887 | A1 | 5/1997 |
| EP | 1 617 167 | A1 | 1/2006 |
| FR | 2 710 975 | | 4/1995 |
| GB | 478257 | | 1/1938 |
| ZA | 9609862 | A * | 8/1998 |

OTHER PUBLICATIONS

International Preliminary Report on Patentability dated Jan. 5, 2010.

* cited by examiner

*Primary Examiner* — Michael Carone
*Assistant Examiner* — Jonathan C Weber
(74) *Attorney, Agent, or Firm* — Scully, Scott, Murphy & Presser, P.C.

(57) ABSTRACT

The following invention relates to a mount for holding a charge in a breech. The mount attaches, or is integral to, a charge and is provided with a dilation means which rests within a breech of a gun to prevent the charge from sliding back out of the breech when the gun is held at a high angle. The dilation means is fabricated from a material which, when the gun is fired, combusts to leave negligible debris in the breech.

8 Claims, 4 Drawing Sheets

CHARGE MOUNT

Figure 1:
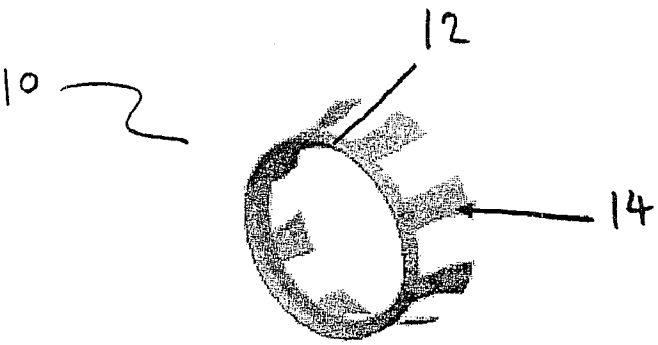

The following invention relates to a mount for holding a charge in a breech.

When loading a round into an elevated gun, components of the round such as the charge can tend to slide out of the breech; if a component of the round slides out of the breech prior to firing, the gun can malfunction.

If the round is provided with a robust cartridge case, the breech mechanism can be designed to clamp the cartridge case firmly and thus prevent the round from sliding out of the breech prior to firing. After firing and prior to a new round being loaded, the cartridge case must be ejected by the breech mechanism.

However if the round is not robust, for example if the charge is exposed, it may not be safe to clamp the round in the breech; there is a risk of unintentionally igniting the charge. Thus, in order to avoid clamping the round or risk the round sliding out of the breech, it is normal to reposition the gun to a lower elevation before reloading.

However, continually raising and lowering the gun between reloading is a time consuming process which reduces the rate of fire. To avoid lowering the gun it is known to provide a groove in the breech such that, when the gun is elevated, an edge of the charge can rest on a ledge formed by the groove; components of the round, which are located further up the breech (e.g. a shell), are in turn held by the charge Such grooves can hold the entire non-robust round at modest elevations but do not reliably hold the round at higher elevations. thus it is still necessary to lower the gun before loading. Furthermore, the groove does not reliably hold the charge; because in the event that the gun is subjected to a knock or vibration, the charge may become dislodged and fall back down the breech. If the charge begins to slide out of the breech, the components of the round located further up the breech are likely to follow.

Ammunition rounds comprising a separately loaded projectile and charge are particularly prone to sliding out of the breech prior to firing because the guns which accept such rounds tend to have unobstructed breeches to allow the components of the round to be rammed into the breech It is therefore an object of the present invention to enable the loading of a non-robust round in a gun at any elevation, hence enabling a higher rate of fire.

Accordingly there is provided a mount for holding a charge in a breech, the mount comprising dilation means for engaging the breech.

Advantageously this prevents the charge from slipping back down the breech once it has been inserted, regardless of which angle the gun has been elevated to fire at (i.e. the firing angle). Beneficially, this allows for a firing rate which is unaffected by the firing angle.

Preferably, the mount is formed of a material that is completely consumed during the firing sequence.

Forming the mount from such a material results in a breech which, after the firing sequence is completed, is free from debris and can receive another round. This eliminates the need for a breech that has an ejection mechanism for disposing of the mount.

Preferably the mount is fabricated from a combination of nitrocellulose, kraft paper and resin binder.

Advantageously, such materials are proven to combust leaving only negligible debris.

Preferably, the dilation means comprises a body member and at least one resilient petal flaring out from the body member Such a dilation means is advantageous because it can be of a simple form, making the mount lightweight, and can be formed from a single piece of material thus making the manufacture relatively straightforward.

Alternatively, the dilation means comprises a male member and a female member, such that as the male member enters the female member, the dilation means dilates so as to engage the breech.

Advantageously this allows for the male and female members to be introduced to the breech without contacting the sides of the breech until this is desired.

Preferably the female member comprises a skirt defining a cavity, an open end of the cavity having an internal width w1, and an inner cross-section of the cavity having an internal width w2; and the male member comprises an edge having width w3; wherein w1>w3>w2, such that the male member can enter the female member through the open end of the cavity until the edge of the male member engages the inner cross-section of the cavity, causing the skirt to dilate.

Advantageously this allows for a dilation to occur at a defined overlap of the male and female member as the male member enters the female member.

Preferably, the skirt comprises at least one resilient petal.

This provides a lightweight structure that can be easily deflected as the male member engages the inner cross section to effect the dilation of the skirt, this structure is relatively straightforward to manufacture.

The following drawings and description are provided to illustrate specific embodiments of the invention, but they do not limit the scope of the invention further than the claims.

FIG. 1 shows a first embodiment of a mount for holding a charge in a breech

Figure 2A:
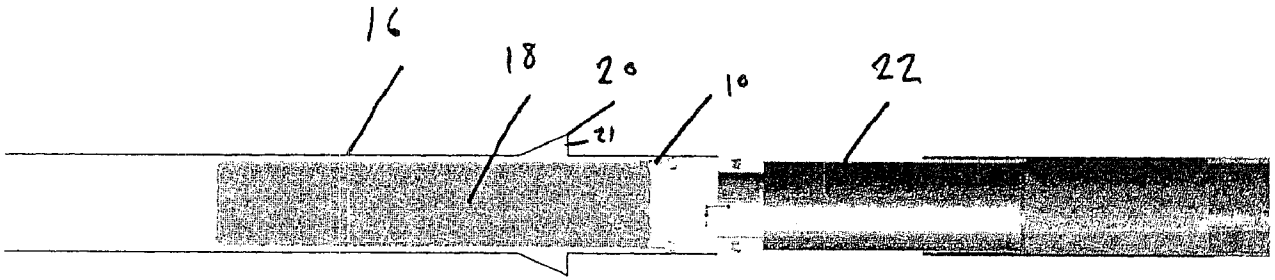

FIGS. 2*a* and *b* show a sectional view of the interaction between the first embodiment of the mount and the breech.

Figure 3B:
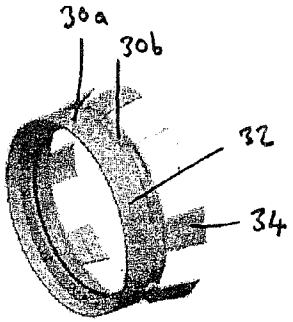
Figure 3A:
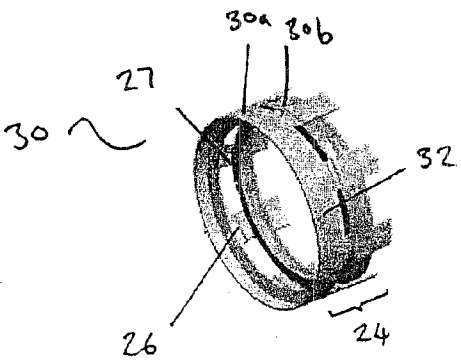

FIGS. 3*a, b* and *c* show a second embodiment of the mount for holding a charge in a breech.

Figure 2B:
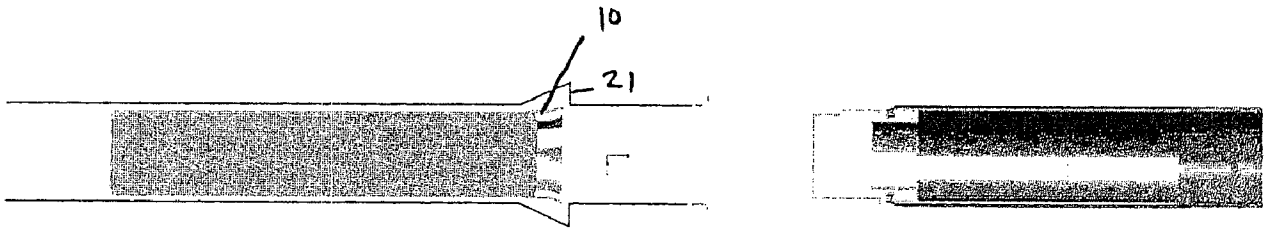
Figure 4A:
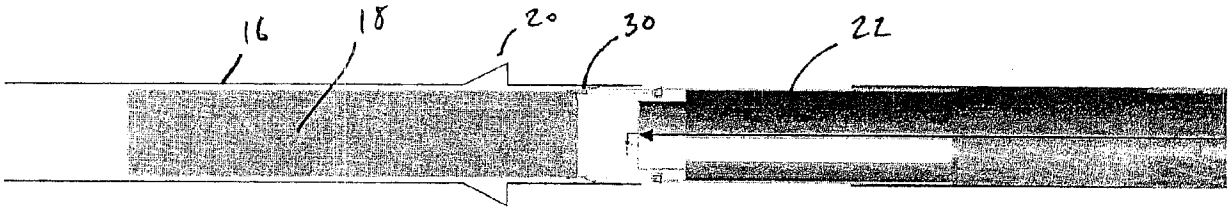
Figure 4B:
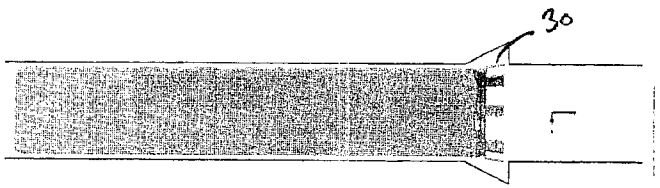
Figure 5:
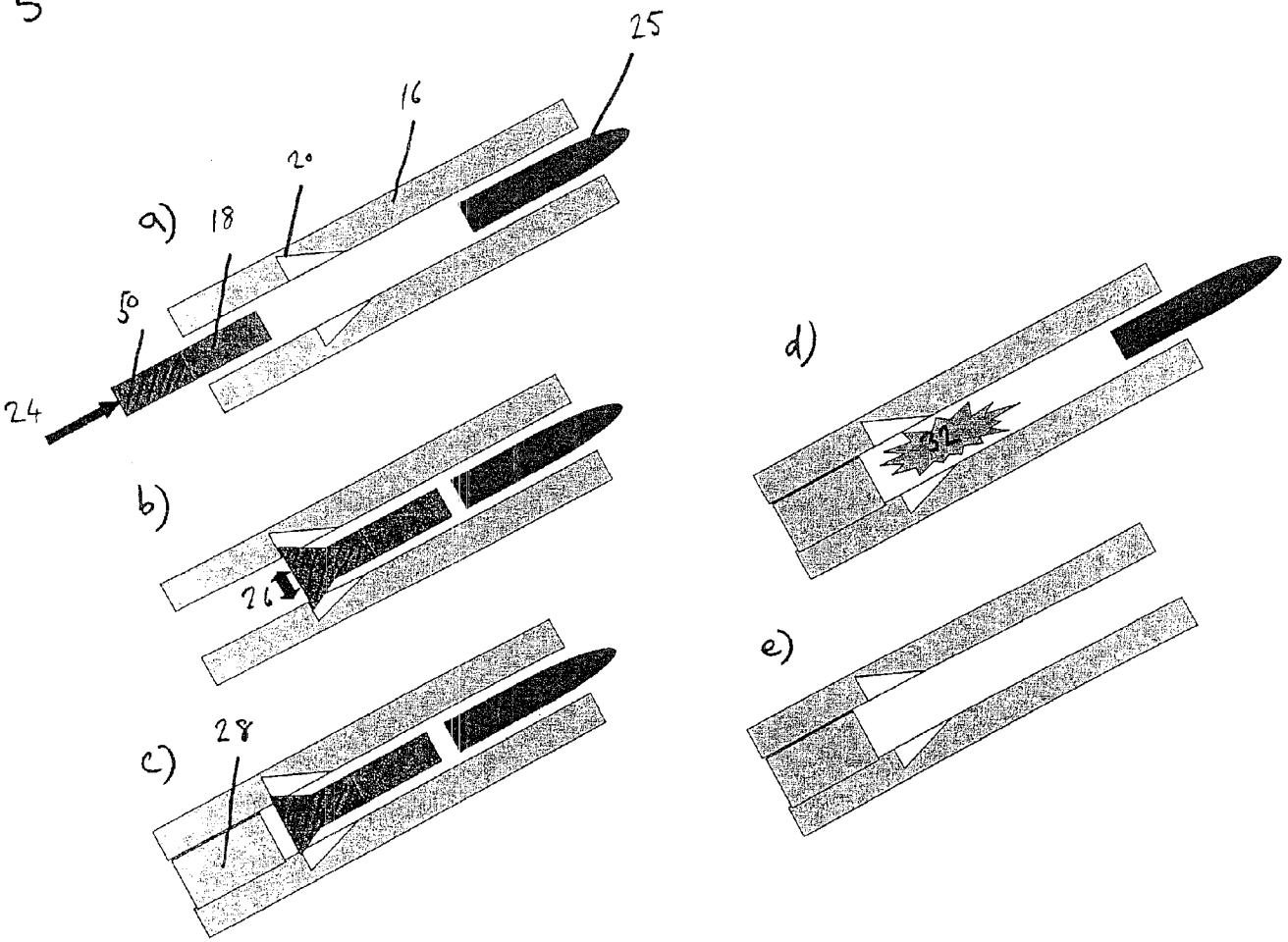

FIGS. 4*a* and *b* show a sectional view of the interaction between the second embodiment of the mount and the breech FIGS. 5*a, b, c, d*, and *e* show the stages involved with the use of the mount in loading a charge into an elevated gun breech and firing the gun A first embodiment of the mount 10, as in FIG. 1, has a hollow cylindrical body 12 having a diameter less than that of a breech 16 (shown in FIGS. 2*a* and 2*b*). Petals 14 flare out from one side of the hollow cylindrical body 12 and define a cavity. The petals 14 are inclined to the longitudinal axis defined by the body 12 thus occupying a diameter greater than that of the body 12. The external sides of the petals 14 flare out to a diameter greater than that of the breech 16. The petals 14 are resilient and biased to flare out to this diameter.

The body 12 of the mount 10, with the petals 14 trailing behind, attaches to a tail end of a charge 18. The body 12 is hollow and the petals 14 are flared so there is an unobstructed passage for a ram 22 to contact the charge 18.

As the combination of the charge 18 and the mount 10 are introduced into the breech 16, the petals 14 contact the insides of the breech 16 and are partially collapsed, see FIG. 2*a*. Upon progressing into the breech 16 a certain distance, the petals reach a groove 20 of the breech 16 and dilate, see FIG. 2*b*. The groove 20 defines a ledge 21 which extends from the breech wall. The petals 14 of the mount 10 rest on the ledge 21 to prevent the mount 10 and charge 18 from slipping back down the breech 16.

Figure 3C:
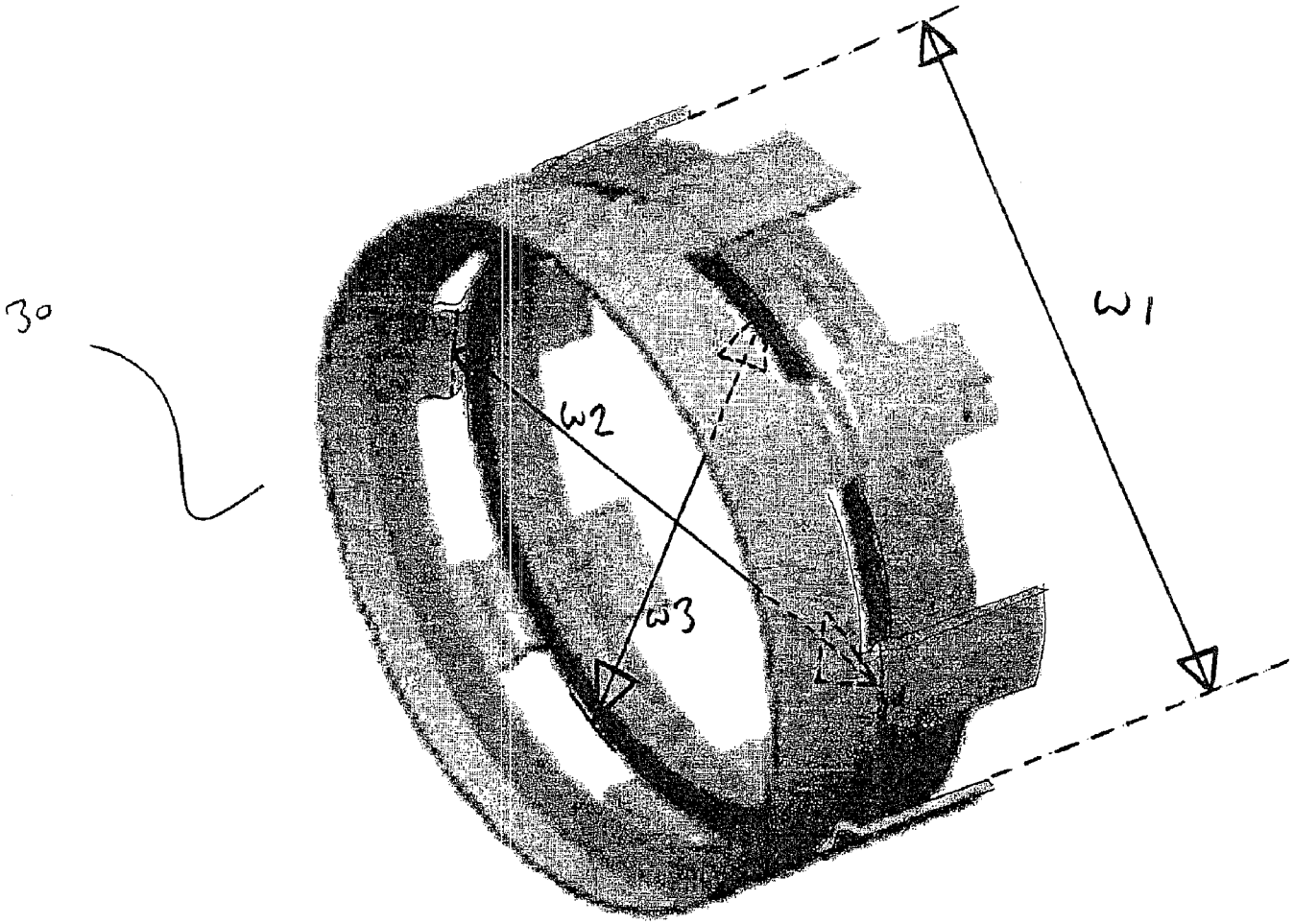

A second embodiment of the mount 30, as shown in FIGS. 3*a*, 3*b* and 3*c*, has a male member 30*b* and a female member 30*a*.

The female member 30*a* comprises a hollow cylindrical body 32 with petals 34 extending out from one end. The petals 34 form a skirt 24 that defines a cavity; an open end of the cavity has internal width w1. In this example however, the petals 34 are not biased to flare out from the body but are biased to maintain a constant diameter which is generally the same as the body diameter. This diameter is less than the diameter of the breech 16 to which the mount 30 will be introduced. Each petal 34 is provided with protrusions, specifically crimps 26, each being located about at the same point on the longitudinal axis defined by the body 32. The crimps 26 define an inner cross-section of the cavity which has a width w2 that is less than internal width w1.

The male member 30*b* has the form of a ring, comprising an edge 27 having width w3, and has a constant diameter. The diameter of the ring w3 is less than the width of the open end of the cavity w1 but is greater than the diameter of the cross-sectional diameter defined by the crimp w2.

The male 30*b* and female 30*a* members are arranged so that if the male member 30*b* slides under the skirt 24 of the female member 30*a* and towards the crimps 26, the edge 27 of the male member 30*b* contacts the crimps 26 and causes the petals 34 to dilate as shown in FIG. 3*b*.

In operation, once a shell 25 has been loaded into the breech 16, a charge 18 in combination with a mount 50 according to either embodiment, is loaded into the breech 16 of a gun by a ram 24 as at FIG. 5*a*.

The charge 18 and mount 50 reach a position behind the shell 25, where the mount 50 abuts the groove 20 to hold the charge 18 in position, as per FIG. 5*b*. This prevents the charge 18 from sliding back down the breech 16 thus also holding the shell 25 and also protecting the charge 18 against vibration or other knocks against the side of the breech 16; consequently the likelihood of the charge 18 igniting inadvertently is much reduced.

Once the shell 25 and charge 18 are loaded and the breech closure 28 shut, the gun can be fired by igniting the charge 18 as per FIG. 5*d*. Combustion reaction 32 forces the shell 25 out of the breech 16, along the barrel, and out of the gun.

The charge 18 and mount 50 are such that the combustion reaction 32 does not leave debris in the breech 16 that would be prohibitive to further use, see FIG. 5*e*.

The mount 50 is made from a material which is consumed entirely upon completion of the firing sequence. One such suitable material would be Combustible Case Material. This material is well known in the art and comprises varying combinations of nitrocellulose, kraft paper and resin binder.

The presented embodiments have made use of a groove 20 upon which rest the dilated petals 14, 24 of the mount thus allowing the charge 18 to be held in the breech 16. However, it is within the scope of the invention to have a mount which does not require a groove 20 in the breech 16, but instead holds the charge 18 by the frictional force between the resilient petals 14, 24 and a smooth section of the breech 16.

Alternative embodiments of the mount where the mount is integral to the charge are within the scope of the present invention.

The invention claimed is:

1. A Charge Holding Mount configured for holding a charge in a breech, the mount comprising:

a dilatable portion for engaging the breech, the dilatable portion being arranged to dilate upon progression into the breech;

a male member; and a female member, the female member including the dilatable portion, the dilatable portion includes an inwardly extending protrusion at an inner cross-section area of the female member, such that as the male member enters the inner cross-section area of the female member and contacts the protrusion, the dilatable portion is actuated so as to engage the breech, the male and female members formed of a material that is completely consumed during a firing sequence.

2. A mount according to claim 1 fabricated from a combination of nitrocellulose, haft paper and resin binder.

3. A mount according to claim 1, wherein the dilatable portion comprises a body member and at least one resilient petal flaring out from the body member.

4. A mount according to claim 1 in which:

the female member comprises:

a skirt defining a cavity, an open end of the cavity having an internal width w1, and the inner cross-section area of the cavity at the protrusion having an internal width w2; and in which the male member comprises an edge having width w3; and wherein w1>w3>w2, such that the male member can enter the female member through the open end of the cavity until the edge of the male member engages the inner cross-section area of the cavity at the protrusion, causing the skirt to dilate.

5. A mount according to claim 4 wherein the skirt comprises at least one resilient petal.

6. A dilation means according to claim 1 comprising a cylindrical body member.

7. A dilation means according to claim 1 comprising a hollow body member.

8. A charge comprising a mount according to claim 1.

* * * * *